United States Patent [19]

Broadwith

[11] 4,381,182

[45] Apr. 26, 1983

[54] FUEL INJECTION PUMP

[75] Inventor: Brian E. Broadwith, Hadleigh, England

[73] Assignee: Lucas Industries Limited, Birmingham, England

[21] Appl. No.: 167,384

[22] Filed: Jul. 9, 1980

[30] Foreign Application Priority Data

Jul. 27, 1979 [GB] United Kingdom ..... 7926294

[51] Int. Cl.[3] ..... F04B 39/00; F04B 27/08; F04B 19/22

[52] U.S. Cl. ..... 417/435; 417/462

[58] Field of Search ..... 417/462, 435

[56] References Cited

U.S. PATENT DOCUMENTS

| | | | |
|---|---|---|---|
| 2,819,678 | 1/1958 | Nordell et al. | 417/571 |
| 3,936,244 | 2/1976 | Drori | 417/462 X |
| 4,310,291 | 1/1982 | Green et al. | 417/462 X |

*Primary Examiner*—William L. Freeh

[57] ABSTRACT

A fuel injection pump of the rotary distributor type has a main pumping chamber including a bore in which is located a plunger and an auxiliary pumping chamber including a further bore and a further plunger. Speed responsive valve means is provided which connects the two bores together for starting purposes. In order to permit air to escape from the bores a spill passage is connected by a passage to the further bore and the spill passage is brought into communication with a spill port while fuel is being supplied to the bores.

1 Claim, 4 Drawing Figures

FUEL INJECTION PUMP

This invention relates to a fuel injection pump for use with an internal combustion engine, the pump comprising a main pumping chamber housing a main plunger, an auxiliary pumping chamber housing an auxiliary plunger, the pumping plungers being operable to pressurize charges of fuel in the chambers to a pressure suitable for delivery to the associated engine, valve means operable upon the attainment of a predetermined engine speed, to disable the auxiliary pumping chamber so that the supply of fuel to the engine is from the main chamber only and means for supplying fuel to the pumping chambers.

Such a pump is described and claimed in the specification of British Pat. No. 1,512,134. It is well known that the presence of air within the various passages in the pump particularly those connected to the pumping chambers, can cause difficulties and in some cases prevent the delivery of fuel by the pump. Air can enter the pump if for example the fuel tank from which fuel is supplied to the pump is allowed to run dry. It is therefore desirable that air drawn into the pump should be expelled as quickly as possible and moreover that this action should be automatic.

According to the invention a pump of the kind specified includes a spill passage connected with said auxiliary pumping chamber and a spill port which is brought into communication periodically with said spill passage whilst fuel is being supplied to said auxiliary pumping chamber.

One example of a fuel pump in accordance with the invention will now be described with reference to the accompanying drawings in which.

Figure 1:
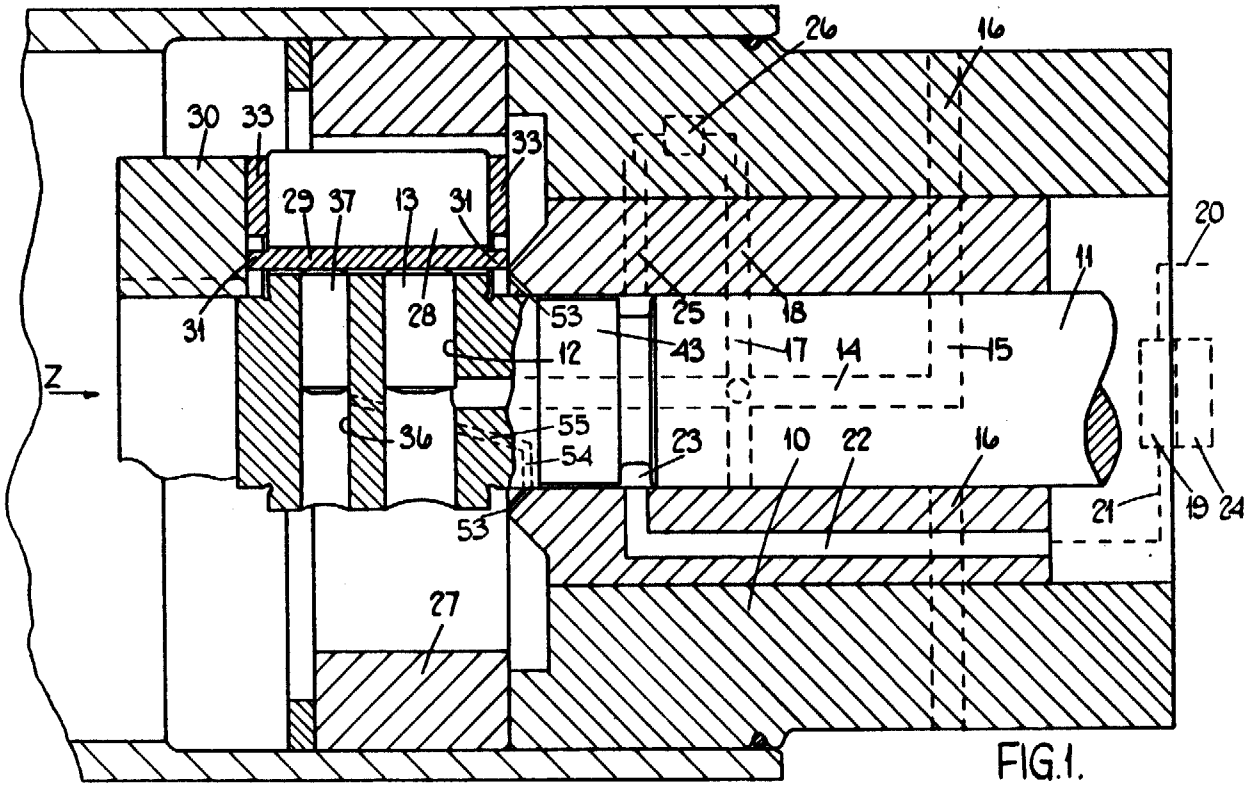
FIG. 1 is a part sectional side elevation of a portion of the pump.

Referring to the drawings the pump comprises a body part 10 in which is mounted a rotary cylindrical distributor member 11. At one end the distributor member is coupled to a drive shaft not shown which in use is adapted to be driven by the associated engine in timed relationship therewith. Moreover, formed in the distributor member is a transversely extending bore 12 in which is mounted a pair of pumping plungers 13 only one of which is shown. The pumping plungers and the bore define between them a main pumping chamber.

Extending within the distributor member and communicating with the bore 12 intermediate the ends thereof, is a passage 14 which communicates with a radially disposed delivery passage 15 the latter being positioned to register in turn with a plurality of outlet ports 16 which in use are connected to injection nozzles respectively of the associated engine.

The passage 14 also communicates with a plurality of radially disposed inlet passages 17 and these can communicate in turn with an inlet port 18 which is formed in the body part 10. Also provided is a feed pump 19 shown in dotted outline but incorporating in a well known manner, a rotary part which is mounted upon the distributor member 11. The feed pump has an inlet 20 for connection to a source of fuel for example a fuel tank, by way of a fuel filter and possibly a priming pump.

Associated with the feed pump is a valve 24 the purpose of which is to ensure that the outlet pressure of the feed pump varies in accordance with the speed at which the associated engine operates.

Formed in the periphery of the distributor member is a circumferential groove 23 which is in constant communication with a passage 22 connected to the outlet 21 of the feed pump. The groove 23 effects a connection between the passage 22 and a further passage 25 which is formed in the body part and which is connected to the port 18 by way of a fuel control device 26. The device 26 in the drawing is shown in block form but it may comprise a simple adjustable throttle whereby the amount of fuel which can flow through the port 18 when it is in register with a passage 17 can be controlled.

Mounted within the body 10 is an annular cam 27 on the internal peripheral surface of which are formed cam lobes and conveniently the cam ring is angularly adjustable within the body 10 to enable the timing of delivery of fuel by the pump to be adjusted. For engagement with the cam lobes there is provided a pair of rollers 28 only one of which is shown, the rollers being carried by shoes 29 which are located within radially disposed slots in the distributor member, the slots being aligned with the bore 12.

In operation the cam lobes are so disposed that when the port 18 is in register with a passage 17, the plungers 13 can move outwardly as fuel is supplied to the bore 12 and by an amount which is determined by the setting of the device 26. As the distributor member continues to rotate the passage 17 is moved out of register with the port 18 and the passage 15 moves into register with a port 16. When the registration of the passage 15 with a port 16 is established, inward movement is imparted to the plungers 13 by the interaction of the rollers 28 with the cam lobes.

Figure 2:
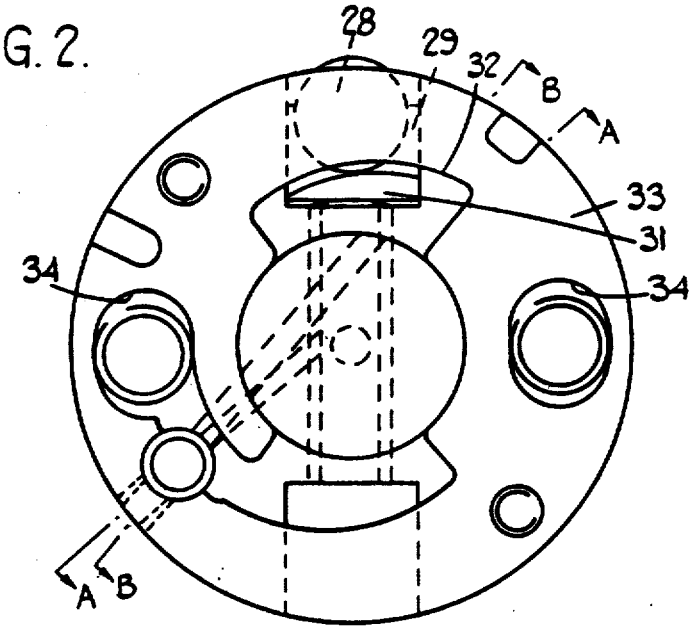
FIG. 2 is a view in the direction of the arrow Z of FIG. 1 with parts removed for the sake of clarity.
Figure 3:
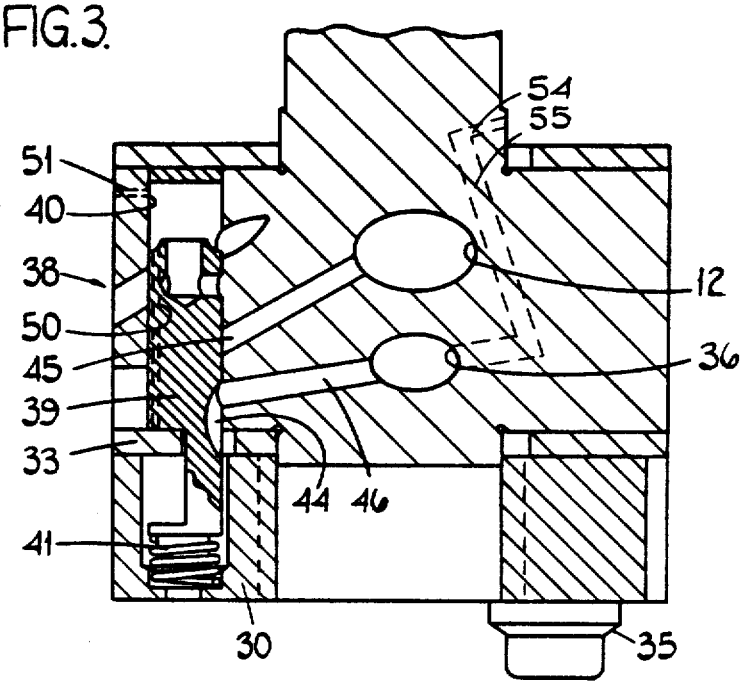
FIG. 3 is a section on the line AA of FIG. 2.

In order to limit the maximum quantity of fuel which can be supplied to the engine under normal operating conditions the extent of outward movement of the plungers 13 is controlled and this is effected by limiting the outward movement of the shoes 29. As will be seen in FIG. 1 the shoes 29 have extensions 31 at their opposite ends and as shown in FIG. 2, the extensions have a curved outer surface for engagement with complementary surfaces 32 formed on a pair of ring members 33 surrounding the distributor member. The surfaces on the extensions 31 and the surfaces 32 are not of constant radius so that angular adjustment of the members 33 will effect an adjustment in the extent of outward movement permitted to the shoes 29. One of the ring members 33 is of plate like form and is provided with a pair of elongated apertures 34 through which extend securing bolts 35 which are seen in FIG. 3. The bolts 35 serve to secure a ring member 33 to the distributor member at the same time gripping the plate member 33 to prevent angular movement thereof once adjustment has taken place. The ring member 33 is internally splined for connection to the aforesaid drive shaft. The other ring member 33 is positioned for engagement by the extensions 31 at the other ends of the shoes and this ring member may be coupled to the first mentioned ring member so as to move angularly therewith during the adjustment process.

When starting an engine and particularly when the engine is cold it is necessary to provide an additional quantity of fuel and with the arrangement described this could only be achieved by adjusting the ring members 33. In order to overcome this problem a further tranversely extending bore 36 is formed in the distributor member and is provided with a further pair of plungers 37. The bore 36 and the further pair of plungers constitute an auxiliary pumping chamber. It will be noted from FIG. 1 that the diameter of the bore 36 together with the diameters of the plungers 37 is less than the diameter of the bore 12 and the diameters of the plungers 13. Conveniently the bores 36 and 12 are aligned so that the plungers 13 and 37 engage with the same pair of shoes 29.

When the bores 12 and 36 are in communication with each other, an additional quantity of fuel will be supplied by the apparatus because the plungers 37 will operate in the same manner as the plungers 13. It is necessary however to ensure that the additional quantity of fuel is supplied to the engine for no longer than is necessary. For this purpose a valve is provided which establishes or breaks the communication between the bores 12 and 36. When the communication is broken the auxiliary pumping chamber is disabled and only fuel which is supplied by the main pumping chamber is delivered to the associated engine.

Figure 4:
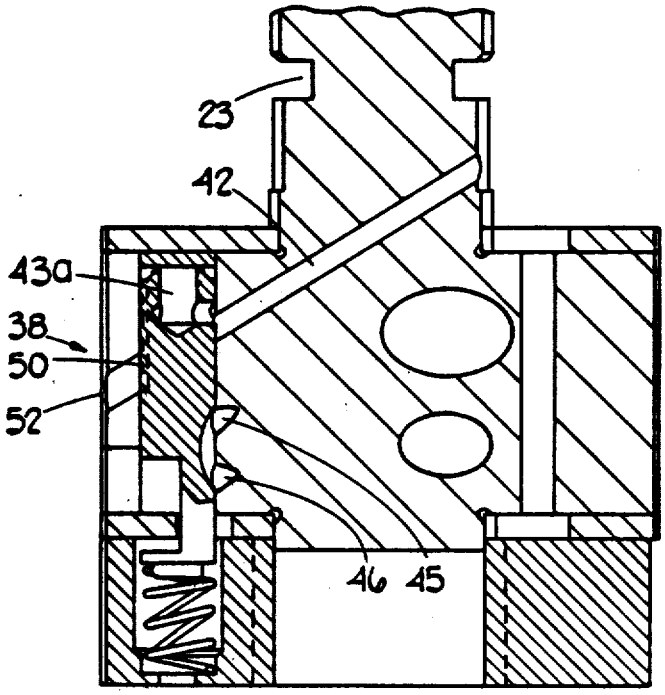
FIG. 4 is a section on the line BB of FIG. 2 also illustrating a portion of the pump at an alternative setting.

The valve is seen at 38 in FIGS. 3 and 4 and it comprises a valve member 39 which is accommodated within a bore 40 formed in the distributor member and extending substantially parallel to the rotary axis thereof. The valve member is biassed by a coiled compression spring 41 which is accommodated within an extended portion of the bore 40 defined in the member 30. At its opposite ends the valve member 39 is subjected to the pressure of fuel delivered by the feed pump and this supply of fuel is conveyed to the bore 40 by means of a passage 42 which is formed in the distributor member and which communicates with a slightly reduced portion 43 of the distributor member adjacent the groove 23 so that the passage 42 is effectively in communication with the outlet 21 of the feed pump. A passage 43*a* is formed in the valve member to communicate the passage 42 with the end of the bore 40. The valve member 39 is provided with a longitudinal groove 44 the purpose of which when the valve member is in the position shown in FIG. 4, is to place the passages 45 and 46 in communication with each other. These two passages communicate with the bores 12 and 36 respectively. In the alternative position of the valve member as seen in FIG. 3, the passage 45 is closed and the passage 46 is placed in communication by way of the groove 44 with a drain conveniently a space within the housing and communicating with the inlet of the feed pump or with a drain pipe extending to the fuel tank.

When the engine is at rest the output pressure of the feed pump will be zero and therefore the valve member 39 will assume the position shown in FIG. 4 under the action of the spring 41 in this position the two passages 45 and 46 are in communication with each other so that when an attempt is made to start the engine both sets of plungers 13 and 37 will be effective to deliver fuel to the engine. When the engine starts and its speed of rotation increases, the output pressure of the feed pump will rise to a point at which the valve member 39 is moved against the action of the spring 41 to the position shown in FIG. 3. When this occurs the two passages 45 and 46 are no longer in communication so that the plungers 37 are no longer effective to supply fuel to the engine. The bore 36 containing the plungers 37 is therefore in communication with the aforesaid space and since this will in practice, be pressurized, the plungers 37 will be held in their inner most position.

The valve member 39 may be provided with a differential action so that a higher pressure of fuel is required to effect the initial movement of the valve member than is required to maintain it in the position shown in FIG. 3. This can be achieved as is shown by shaping the end of the valve member to define a seating so that only a portion of the valve member is subjected initially to the fuel pressure. The outer annular area of the valve member can be vented to a drain by way of a restricted passage this passage may be formed in the valve member or it can be formed in the wall of the bore 40. The passage in the valve member is shown at 50 in FIG. 4 and the passage in the wall of the bore is shown at 51 in FIG. 3.

When air is drawn through the inlet 20 it will flow along with fuel, along the passage 22 and find its way into the pumping chambers and the passages within the distributor member which are connected thereto. The presence of air can upset the precise control of the quantity of fuel flowing from the pump to the associated engine and in some circumstances can prevent flow of fuel completely owing to the effect of delivery valves which will very likely be incorporated in each outlet 16. The delivery valves require a predetermined pressure of fuel before they open and if air is present in the various passages it will compress as the plungers move inwardly and may prevent sufficient pressure being generated to open the delivery valves. For the purpose of allowing air to escape from the various passages there is formed in the body 10 a plurality of spill ports 53 the number of spill ports is equal to the number of passages 17 and the spill ports open into the aforesaid space defined in the body. For registration in turn with the spill ports 53 there is provided a spill passage 54 which by way of a passage 55 communicates with the bore 36. The communication of the spill passage 54 with a spill port 53 is arranged to take place whilst the port 18 is in communication with one of the passages 17. When starting the associated engine therefore as soon as the passage 17 is brought into register with the port 18, fuel together with entrained air, flows to the bore 12 and then on to the bore 36 by way of the passages 45 and 46. From the bore 36 the fuel and air flows along the passage 55 to the passage 54 and through the port 53 which is in register therewith. Hence, each time the passage 54 is brought into register with a port 53 some fuel together with entrained air will escape into the aforesaid space. Such flow of fuel and air will only take place during the engine starting sequence but it is expected that most if not all of the air will be displaced during the starting sequence since this may in itself be extended due to the fact that fuel is not being supplied to the engine because of the presence of air in the pump. Clearly if there is no air within the passages and bores then only fuel will flow through the spill ports 53. These are of a flow restrictive nature which restricts the rate of flow of fuel but not air so that the flow of fuel through the ports 53 will not significantly impair the ability of the pump to supply fuel to the engine.

I claim:

1. A fuel injection pump for use with an internal combustion engine comprising a body part, a rotary distributor member housed in said body part, a fuel delivery passage in said rotary part, a plurality of fuel inlet passages defined in said rotary part to periodically fluidly connect said delivery passage with fuel inlet passages defined in said body part and to disconnect such passages at other times as said rotary part rotates, a main pumping chamber formed within said distributor member housing a main plunger, an auxiliary pumping chamber formed within said distributor member housing an auxiliary plunger, the pumping plungers being operable to pressurize charges of fuel in the chambers to a pressure suitable for delivery to the associated engine, valve means operable upon the attainment of a predetermined engine speed to disable the auxiliary pumping chamber so that the supply of fuel to the engine is from the main chamber only, means for supplying fuel to the pumping chambers, a spill passage means formed in said rotary distributor member and having an inlet end thereof fluidly connected with said auxiliary pumping chamber and an outlet end thereof fluidly connected with any one of a plurality of spill ports formed in said body part, said spill passage means being located in said distributor member and said spill ports being located in said body part so that said distributor located outer end is in fluid communication with one of said body located spill ports when said inlet and fuel delivery passages are in fluid communication with each other and are out of fluid communication with each other when said fuel delivery passages are out of communication with each other, so that said spill means outlet end and one of said spill ports are brought into fluid communication with each other during essentially the entire time fuel is being supplied to said auxiliary chamber.

* * * * *